US008276902B2

(12) United States Patent
Holland-Letz et al.

(10) Patent No.: US 8,276,902 B2
(45) Date of Patent: Oct. 2, 2012

(54) DEVICE FOR HANDLING SINGLE SHEETS, FOR INTRODUCING RECTANGULAR INDIVIDUAL SHEETS INTO A CONTAINER

(75) Inventors: Günter Holland-Letz, Paderborn (DE); Ayhan Aslan, Paderborn (DE); Sascha Ringel, Paderborn (DE)

(73) Assignee: Wincor Nixdorf International GmbH (DE)

( * ) Notice: Subject to any disclaimer, the term of this patent is extended or adjusted under 35 U.S.C. 154(b) by 31 days.

(21) Appl. No.: 12/936,117

(22) PCT Filed: Apr. 15, 2009

(86) PCT No.: PCT/EP2009/054447

§ 371 (c)(1),
(2), (4) Date: Nov. 11, 2010

(87) PCT Pub. No.: WO2009/127649

PCT Pub. Date: Oct. 22, 2009

(65) Prior Publication Data

US 2011/0042889 A1 Feb. 24, 2011

(30) Foreign Application Priority Data

Apr. 15, 2008 (DE) ..... 10 2008 018 961

(51) Int. Cl.
*B65H 83/00* (2006.01)

(52) U.S. Cl. ..... 271/3.14; 271/315

(58) Field of Classification Search ..... 271/3.14, 271/4.01, 4.08, 10.01, 10.09, 315
See application file for complete search history.

(56) References Cited

U.S. PATENT DOCUMENTS

| | | | | |
|---|---|---|---|---|
| 4,235,433 | A | 11/1980 | Hirata | |
| 4,517,451 | A | 5/1985 | Kokubo et al. | |
| 4,542,287 | A | 9/1985 | Watanabe et al. | |
| 4,591,142 | A | 5/1986 | Divoux et al. | |
| 4,616,817 | A | 10/1986 | Yamauchi et al. | |
| 4,753,431 | A | 6/1988 | Fujimoto et al. | |
| 5,000,322 | A | 3/1991 | Goi | |
| 5,058,880 | A | 10/1991 | McGraw et al. | |
| 5,098,080 | A | 3/1992 | Arnone et al. | |
| 5,156,393 | A | 10/1992 | Erkisson | |
| 5,194,558 | A * | 3/1993 | Carlston et al. | 528/60 |
| 5,271,613 | A | 12/1993 | Hain | |
| 5,553,320 | A | 9/1996 | Matsuura et al. | |
| 6,331,000 | B1 | 12/2001 | Beskitt et al. | |
| 6,682,068 | B1 | 1/2004 | Haney et al. | |

(Continued)

FOREIGN PATENT DOCUMENTS

DE 3237821 C2 5/1983

(Continued)

*Primary Examiner* — Michael McCullough
(74) *Attorney, Agent, or Firm* — Harness, Dickey & Pierce, P.L.C.

(57) ABSTRACT

A single sheet handling device (20) for the input and/or output of at least one single sheet (38) respectively into and out of a container (20). The single sheet handling device (30) has a vane wheel (54) with at least one vane (58, 59). The vane (58, 59) presses at least a part of the single sheets (38) arranged in a stack (36) in the container (20) into the container (20) upon a contact of the vane (58, 59) with the front side of the stack (36) or holds these single sheets in a position in the container (20). The vane (58, 59) has an inner rigid first area (72, 74) and a flexible second area (76, 78) extending outwardly beyond the first area (72, 74).

20 Claims, 4 Drawing Sheets

U.S. PATENT DOCUMENTS

| | | | |
|---|---|---|---|
| 6,889,897 | B2 | 5/2005 | Nomiyama et al. |
| 2003/0127509 | A1 | 7/2003 | Nomiyama et al. |

FOREIGN PATENT DOCUMENTS

| | | | |
|---|---|---|---|
| DE | 33 25 182 | C2 | 2/1984 |
| DE | 19904540 | A1 | 8/2000 |
| EP | 0148310 | B1 | 7/1985 |
| EP | 0364790 | A2 | 4/1990 |
| EP | 0672600 | A1 | 9/1995 |
| EP | 0714078 | B1 | 5/1996 |
| EP | 1 326 215 | A2 | 7/2003 |
| FR | 2 538 797 | A1 | 7/1984 |
| GB | 2301092 | A | 11/1996 |
| JP | 59 0120756 | U | 8/1984 |
| JP | 61 094936 | A | 5/1986 |
| JP | 61 127522 | A | 6/1986 |
| JP | 62 153233 | U | 9/1987 |
| JP | 63 165229 | A | 7/1988 |
| JP | 63 208466 | A | 8/1988 |
| JP | 02 221055 | A | 9/1990 |
| JP | 6001514 | | 1/1994 |
| JP | 06 263303 | A | 9/1994 |
| JP | 2005 132628 | A | 5/2005 |
| WO | WO-00/24662 | A1 | 5/2000 |

* cited by examiner

DEVICE FOR HANDLING SINGLE SHEETS, FOR INTRODUCING RECTANGULAR INDIVIDUAL SHEETS INTO A CONTAINER

CROSS-REFERENCE TO RELATED APPLICATIONS

This application is a National Stage of International Application No. PCT/EP2009/054447, filed Apr. 15, 2009. This application claims the benefit and priority of German application 10 2008 018 961.8, filed Apr. 15, 2008. The entire disclosures of the above applications are incorporated herein by reference.

BACKGROUND

This section provides background information related to the present disclosure which is not necessarily prior art.

TECHNICAL FIELD

The invention relates to a single sheet handling device for the input of rectangular single sheets into a container. Such rectangular single sheets are in particular banknotes which are automatically supplied to a transportable container for storage.

DISCUSSION

From the documents U.S. Pat. Nos. 4,616,817 A, 6,682,068 B1 and WO 00/24662 A1 arrangements are known in which deposited banknotes are supplied to individual storage compartments which cannot be separated from the arrangements. From the document DE 33 25 182 02 a further arrangement for storing single sheets in fixed storage compartments which cannot be separated from the arrangement is known, in which stacking wheels are used for feeding the single sheets into the storage compartments. Further, so-called cash recycling devices are known in which deposited banknotes are fed to a storage compartment and, when withdrawn at future points in time, are again removed from this compartment. A cash recycling device of this type having storage compartments which cannot be separated from the device is known, for example, from the document EP 0 148 310 B1.

From the document DE 199 04 540 A1, a banknote storage container for cash withdrawal machines is known. Further, from the document U.S. Pat. No. 6,889,897 B2, a banknote storage container is known in which a large number of feeding elements as well as alternatively a large number of separating elements are arranged in the banknote storage container itself which is designed as a cassette. This, however, has the disadvantage that these elements also have to be provided in replacement cassettes and that in the cassette itself space has to be provided for the feeding and separating elements, which space can no longer be used for the banknote storage. Another disadvantage of arranging feeding and separating elements in the cassette is that these elements increase the weight of the cassette, and therefore the transport expense for the transport of the cassette is increased. However, in order to enable the feeding of banknotes into a banknote container and the removal of banknotes from the same container, the feeding and separating elements have to be positioned accurately with respect to the stack surface or, respectively, the front side of the banknote stack contained in the container so that a reliable banknote transport into and out of the container is made possible.

SUMMARY OF THE INVENTION

It is an object of the invention to specify a single sheet handling device for the input of rectangular single sheets into a container, which device positions the single sheets correctly in the container in an easy manner.

By means of a single sheet handling device, both a flexible stop for a single sheet to be supplied to the container can be formed and the contact area between the front side of the stack contained in the container and the vane wheel can be increased when the vane wheel is appropriately driven. In particular, the contact area during feeding of a single sheet after a vane change-over, i.e. upon contact of a single sheet arranged in a feeding area in front of the stack already contained in the container with the vane or, respectively, with a further vane of the vane wheel, is increased. A portion of the flexible area of the vane contacts the supplied single sheet already in its lower half and presses the single sheet at least in the contact area against the front side of the stack already contained in the container. In this process, the single sheets are arranged in the stack standing on their longitudinal edges, and thus they are arranged standing on these longitudinal edges also in the container. The rigid area of the vane then presses the stack with the supplied single sheet into the container and creates a feeding area or, respectively, a feeding gap for feeding a further single sheet. By the contact of the supplied single sheet with the flexible area of the vane a heavy fluttering of the single sheet in its lower half is avoided. As a result thereof, further pressure elements for pressing the supplied single sheet against the front side of the stack and/or for avoiding fluttering of the banknote are not compulsory. However such further pressure means can be additionally provided.

In a development of the invention, the vane wheel has a hub with which the vane is firmly connected. With the aid of such a hub the vane or, respectively, the vane wheel can be easily arranged on a shaft. Preferably, the hub is dimensioned such and/or further means for connecting the hub to a drive shaft are provided such that the hub and thus the vane is connected to the drive shaft in a rotationally fixed manner.

Further, it is advantageous if the vane wheel has at least two identically formed vanes. The two vanes then preferably extend in opposite directions. Here, it is particularly advantageous when the vanes extend in opposite directions in parallel planes. The vanes preferably have an identical structure. As a result thereof, a so-called vane change-over with a relatively short change-over time can be caused in that the drive shaft for driving the vane wheel is rotated by 180° during feeding of a single sheet. In a basic feeding position, the vanes are substantially horizontally oriented so that in the case of single sheets standing vertically on their longitudinal edges on the container bottom these are pressed into the container by the end of the first area of the vane and/or are kept at a distance to the axis of rotation of the vane wheel and to further elements of the single sheet handling device. As a result thereof, a feeding gap for feeding a further banknote to be supplied can be created in front of the stack or, respectively, between the stack and further elements of the single sheet handling device.

As already described further above, during feeding of a single sheet, the vane wheel is rotated so that the vane contacting the front side of the stack already contained in the container is moved away in the feeding direction of the single sheet so that the front edge of the supplied banknote at least does not contact the rigid area of the vane. Upon a further rotation, the first vane previously contacting the front side of the stack passes an apex of the enveloping circle of the vane wheel, preferably its upper apex. At the same time, also the opposite second vane of the vane wheel passes the opposite apex of the enveloping circle of the vane wheel, preferably its lower apex.

When the vane wheel is rotated further, the second vane is moved towards the face or, respectively, the back of the single sheet positioned in front of the front side of the already existing stack and subsequently presses it against the front side of the stack so that the supplied single sheet rests against the stack and forms the new front side of the stack.

It is particularly advantageous when the front portion of the first area of the vane is curved. Preferably, the first vane is curved such that the tip of the curved first area runs behind the remaining first area during a rotation for feeding a single sheet. As a result thereof, the face or, respectively, back of a supplied single sheet is contacted by the outside of the curvature, which makes a particularly smooth contact with the supplied single sheet possible. Further, by means of the curvature edges are avoided which could engage with damages of the supplied single sheet. Further, excessive wear of the single sheet by a contact with the vane is avoided. By means of the curvature also the friction between the vane and the single sheet can be reduced so that less force is transmitted from the vane onto the single sheet during rotation of the vane wheel. As a result thereof, the single sheet is not or only slightly moved upon a contact with the vane during rotation of the vane.

Further, it is advantageous when the inner end of the second area is connected to the first area in a portion set back from the outer end of the first area. Preferably, the inner end of the second area is connected to the first area at a point set back from the curved portion of the first area. It is particularly advantageous when the inner end of the second area is connected to the first area near the base point of the vane, i.e. near the joint between the vane and a hub and drive shaft. As a result thereof, a relatively large radius of curvature for elastically deforming the flexible area of the vane is obtained without a kink occurring in the second area downstream of the point of contact between the inner end of the second area and the first area. As a result thereof, in particular mechanical stress on the second area can be reduced and the life of the flexible area can be increased.

It is particularly advantageous when the inner end of the second area is connected to the non-curved portion of the first area so that an inner portion of the second area and at least the curved portion of the first area overlap one another. It is particularly advantageous when the first area is formed by a rigid plastic molded part and the second area is formed by a strip of a flexible plastic foil which is preferably resistant to bending or a strip of a suitable rubber material. The plastic foil is preferably a polyester foil having a thickness in the range between 0.25 mm and 0.35 mm. A plastic foil of this type has a suitable stiffness in order to press the supplied single sheet into the container or, respectively, press it against the front side of a stack contained in the container upon contact with the single sheet. Further, such a plastic foil or, respectively, such a rubber strip can be deformed when the vane wheel is rotated and when it contacts the supplied single sheet such that it rests against the supplied single sheet not only punctually but with a surface portion.

In a further advantageous embodiment of the invention the non-curved portion of the first area and the second area are arranged such that they are arranged parallel to one another when the second area is not elastically deformed. In the direction of rotation of the vane wheel, the second area is connected to the first area on the back of the first area so that, in the case of a curved outer portion of the first area which runs behind, the second area is elastically deformed by the contact with the curved portion of the first area. As a result thereof, at least the outer portion of the second area is not oriented in parallel to the longitudinal axis of the non-curved area of the vane. When the vane wheel rotates, a stack of single sheets projecting into a feeding area of a single sheet to be supplied is placed or, respectively, kept with the aid of the first area at a defined distance, namely at the distance of the enveloping circle diameter of the vane wheel, to the longitudinal axis of the drive shaft of the vane wheel, the front side of the stack with the supplied single sheet, upon a further rotation of the vane wheel, being kept at a distance to the axis of rotation of the vane wheel by the second area and in particular by the spring force generated by the elastic deformation of the second area upon contact with the front side of the stack.

When the vane wheel rotates further, the second area of the vane can also be elastically deformed by a contact with further elements, in particular with further elements of the single sheet handling device. In particular when the drive shaft of the vane wheel is arranged in a horizontal plane which intersects the stack with the single sheets standing vertically on their longitudinal edges in the upper half of the stack, a height restriction or a further device arranged above the single sheet handling device can nevertheless be present in the enveloping circle of the second area. The further device is in particular a further single sheet handling device. Upon contact with this further device, the second area of the vane is elastically deformed. As a result thereof, the required number of elements of the single sheet handling device as well as its structural height can be reduced.

Further, it is advantageous when the single sheet handling device has a control unit which controls a drive unit for driving the at least one vane wheel such that the control area of the vane has a distance to the front edge of the supplied single sheet during feeding of a single sheet and that the supplied single sheet at least does not contact the rigid area of the vane during feeding.

It is particularly advantageous to provide at least two vane wheels which are arranged on a common shaft in a rotationally fixed manner, which shaft can be rotationally driven with the aid of a drive unit of the single sheet handling device. The vanes of the two vane wheels are oriented identically or, respectively, in parallel. When the drive shaft rotates, one vane each of the two vane wheels presses against the front side of the stack contained in the container.

Further, it is advantageous to provide a sensor arrangement, preferably a light barrier arrangement for detecting a sheet edge of a single sheet to be supplied to the container with the aid of the single sheet handling device. A drive unit of the single sheet handling device controls the drive of the at least one vane wheel such that the drive of the vane wheel is started a preset time after the detection of the sheet edge of the single sheet by the sensor arrangement. It is advantageous to detect the front edge of the single sheet. By detecting the front edge of the single sheet a compact design of the single sheet handling device is made possible.

The enveloping circle of the first area of the vane of the vane wheel is chosen such and the vane wheel is arranged such that the apex of the enveloping circle is arranged approximately at the same height as the front edge of the largest-possible single sheet, given an arrangement in the single sheet receiving area of the container, that can be supplied to the container.

Further, it is advantageous when the vane of the at least one vane wheel pushes the stack into the single sheet receiving area of the container at least when the vane is oriented substantially horizontally.

Optionally, at least one inclined deflector can be provided which guides the front edge of the supplied single sheet from the center of the vane towards the front side of the stack. The inclined deflector is preferably laterally offset relative to the vane wheel. Preferably, the inclined deflector is spring-mounted.

The single sheet handling device can have at least two further lower vane wheels which are arranged on a common drivable shaft and the vanes of which move at least the rear edge of a single sheet to be supplied to the container towards the stack upon a rotation of the shaft when the single sheet is positioned in front of the front side of the stack already contained in the container.

Further, it is advantageous when the single sheet handling device has, in addition to the vane wheel arrangement and further feeding elements for the sheet-by-sheet feeding of single sheets and for depositing these single sheets in a stack, separating elements for the sheet-by-sheet removal of single sheets of the stack from the container. Both the feeding elements and the separating elements are preferably arranged separately from the container so that the container can be easily separated from the single sheet handling device. The separating elements can in particular comprise at least one pull-off wheel, preferably two or three pull-off wheels, which are connected to a drive shaft in a rotationally fixed manner.

BRIEF DESCRIPTION OF THE DRAWINGS

Further features and advantages result from the following description which in connection with the enclosed Figures explains the invention with reference to embodiments thereof.

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
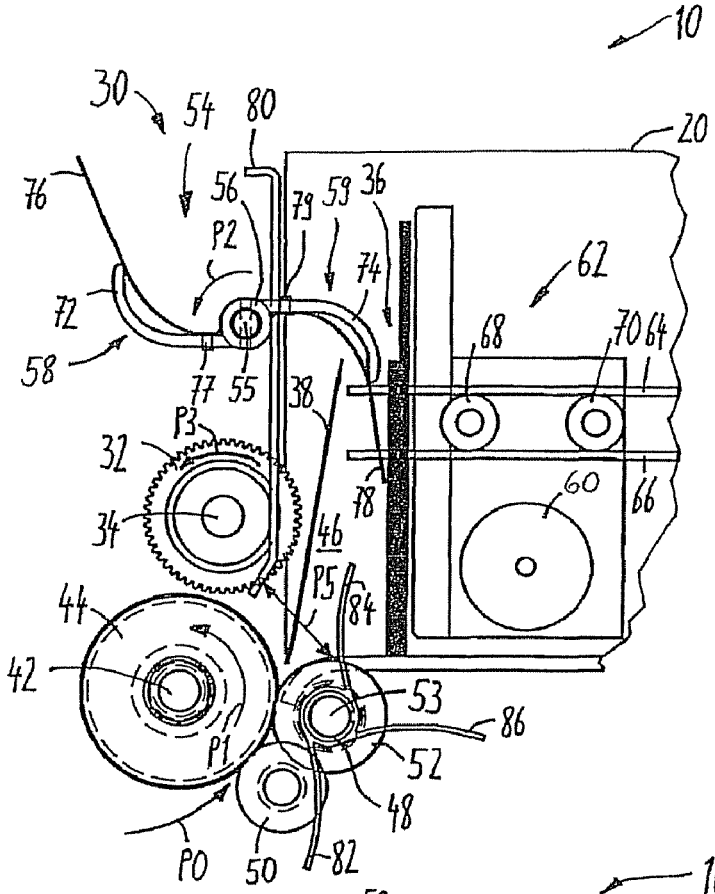
FIG. 1 shows an arrangement comprising a separating and stacking module arranged in a safe of an automated teller machine and comprising a cassette for storing banknotes, feeding elements of the separating and stacking module being illustrated in a first feeding position.

In FIG. 1 an arrangement 10 comprising a banknote cassette 20 arranged in a safe of an automated teller machine for storing banknotes and a separating and stacking module 30 is shown. The separating and stacking module 30 comprises feeding elements 54, 44 which, in the side view of the arrangement shown in FIG. 1, are illustrated in a first feeding position.

The separating and stacking module 30 has further separating elements which, in the embodiment according to FIG. 1, comprise three pull-off wheels 32 arranged next to one another. The pull-off wheels 32 are arranged on a pull-off wheel shaft 34 in a spring-mounted manner and are connected to this shaft 34 in a rotationally fixed manner. In the side view of the separating and stacking module 30 illustrated in FIG. 1, only one of the three pull-off wheels 32 is visible. Further, the pull-off wheel shaft 34 is preferably spring-mounted at an end which is not engaged with drive elements so that the pull-off wheel shaft 34 can be horizontally displaced at this shaft end. As a result thereof, the pull-off wheel shaft 34 with the spring-mounted pull-off wheels 32 arranged thereon can be pressed towards the front side of the cassette 20 and thus against the front side of a banknote stack 36 arranged in a separating position. In the cassette 20, the banknotes are stored as a stack 36, the cassette 20 being formed and arranged such that the stack 36 has a horizontal stacking direction. The individual banknotes are arranged as a stack standing on their longitudinal edges.

In the illustrated embodiment, the stack 36 comprises several banknotes of a first low height, of which the foremost banknote arranged in the stack 36 forms the front side of the stack 36, as well as several banknotes of a higher second height, of which the banknote forming the back of the stack rests against a stop formed by a displacement carriage 62. The displacement carriage 62 restricts the single sheet receiving area or, respectively, the stacking space in the cassette 20 and is displaced relative to the cassette 20 with the aid of a motor 60 arranged on the displacement carriage 62 depending on the stack thickness. By displacing the displacement carriage 62, the stacking area, i.e. the single sheet receiving area, can be increased or reduced as required.

To the side of the stack 36, the cassette 20 has guiding rails 64, 66, into which guiding rolls 68, 70 engage which are connected to the displacement carriage 62 via one axle each projecting from the displacement carriage 62. Further, on one of the guiding rolls 68, 70, a gear wheel is provided which is engaged with a non-illustrated gear rack, is integrated in one of the guiding rails 64, 66 or is separately arranged, and can be driven with the aid of the motor 60. When the drive shaft of the motor 60 rotates, thus the displacement carriage 62 can be displaced in stacking direction or in a direction opposite to the stacking direction.

A banknote to be supplied in the direction of the arrow P0 is transported with the aid of drive wheels 44 arranged on a main drive shaft 42 into a feeding area 46 in front of the stack 36 contained in the cassette 20. With the aid of a pressure roller 50, a banknote 38 is pressed against the drive wheels 44 for transport. Further, two stripping rollers 52 are arranged on a shaft 53, which, in the present embodiment, have a free-wheeling mechanism, so that when the drive wheels 44 rotate in the direction of the arrow P1, they likewise rotate without a rotation of the shaft 53. As a result thereof, a transport of the banknote 38 to be supplied into the feeding area 46 is not impeded by the stripping rollers 52.

When driving the drive wheels 44 opposite to the arrow P1 illustrated in FIG. 1 for separating banknotes, however the stripping rollers 52 do not rotate accordingly. The stripping rollers 52 have a circumferential surface made of rubber or another material having a relatively high coefficient of friction so that whenever two banknotes from the stack 36 reach into the gap between the drive wheel 44 and the stripping roller 52, the banknote facing the stripping roller 52 is stripped off from the banknote facing the drive wheel 44 and is not transported further up to the pressure roller 50. As a result thereof, it can be guaranteed that when banknotes are removed from the cassette 20, i.e. when the banknotes are separated, only one banknote at a time is removed. Thus, the banknotes are removed one after the other at the cassette 20 and double pull-offs are avoided.

Moreover, the separating and stacking module 30 has as a feeding element several vane wheels 54 arranged on a drive shaft 55, each vane wheel having two vanes 58, 59 projecting tangentially from a hub 56 of the vane wheel 54. Via the hub 56, the vanes 58, 59 are connected to the drive shaft 55 in a rotationally fixed manner so that with the aid of the drive unit the vane wheels 54 can be driven via this shaft 55 in the direction of rotation of the arrow P2. The vanes 58, 59 each have a rigid area 72, 74 which is firmly connected to the hub 56 as well as a flexible area 76, 78. The rigid areas 72, 74 are preferably made in one piece with the hub 56, for example, as a molded part. The flexible areas 76, 78 are preferably foil strips, for example, made of a polyethylene foil. The inner end of each of the foil strips 76, 78, or, respectively, an area near the inner end of the foil strips 76, 78, is connected to the non-curved portion of the area 72, 74 at a joint 77, 79, preferably near the hub 56. As types of connections in particular welded connections, adhesive connections, clamping connections, and screwed and riveted connections are suitable.

In FIG. 1, the vane wheel 54 is illustrated in a basic stacking position, i.e. in a first feeding position. In this basic stacking position, the rigid horizontally oriented area 74 of the vane 59 presses against the front side of the stack 36, as a result whereof the banknotes of the stack 36 are pushed out of a feeding area 46 in front of the stack 36 and into the cassette 20. While the vane wheel 54 is in the basic stacking position, the banknote 38 to be supplied to the cassette 20 is transported into the feeding area 46 with the aid of the drive wheels 44. When the banknote 38 is transported into the feeding area 46, the pull-off wheel 32 is additionally driven in the direction of the arrow P3, i.e. in feeding direction of the banknote 38. When the front edge of this banknote 38 falls below a preset distance to the rigid area of the vane 59, the vane wheels 54 are rotated so that the front edge of the supplied banknote 38 does not contact the rigid area 74 of the vane 59 even if the flexible area 78 of the vane 59 would not project downwards from the rigid area 74 or even if the flexible area 78 would not be present. For this, a non-illustrated light barrier arrangement is provided between the drive wheels 44 arranged at a distance to one another and between the pressure rollers 50 arranged at a distance to one another, by which light barrier arrangement the front edge of supplied banknotes 38 can be detected. Thus, this light barrier arrangement monitors the transport path to and from the cassette 20 so that both banknotes during feeding to the cassette 20 as well as banknotes during removal from the cassette 20 are detected with the aid of this light barrier arrangement.

The curved ends of the rigid areas 72, 74 cause an elastic deformation of the flexible areas 76, 78, as a result whereof the flexible areas 76, 78 are biased. By the relatively large overlapping of the rigid areas 72, 74 of the vanes 59, 60 and the flexible areas 76, 78, a relatively large deformation area is available for the flexible areas 76, 78 upon contact with the front side of the banknote stack 36 as well as upon contact with further elements of the separating and stacking module 30 and/or the cassette 20 so that a relatively large radius of curvature is provided during deformation of the elastic areas and the mechanical stress is relatively low. In particular, by the pre-bending of the flexible areas 76, 78 due to the curved ends of the rigid areas 72, 74 kinks are avoided and minimum bending radii are kept, as a result whereof a relatively low stress is imposed and a long life of the flexible areas 76, 78 is achieved.

On the drive shaft 55, in addition to the vane wheel 54 visible in the side view according to FIG. 1, five further upper vane wheels are arranged and connected to this shaft 55 in a rotationally fixed manner, as will be explained in more detail further below in connection with FIG. 5.

Further, in FIG. 1 a note retracting shutter 80 is illustrated in an open position in which it has been moved away from the front side of the stack 36 so that a feeding and removal gap is created which is identified with the arrow P5 in FIG. 1. In the closed state, the inside of the note retracting shutter 80 contacts the front, side of the stack 36 and closes the gap P5 at least so far that no banknote of the stack 36 can be removed without the banknote or the cassette 20 being damaged. The note retracting shutter 80 is preferably brought into the open position illustrated in FIG. 1 by means of non-illustrated drive elements arranged separately from the cassette 20.

Further, non-illustrated springs are provided which exert a force on the note retracting shutter 80 in the direction of its closed position so that the note retracting shutter 80 is moved into the closed position by the spring force and is kept thereat. After feeding the banknotes 38 to be supplied into the feeding area 46, i.e. when the rear edge of the banknote 38 is no longer in the area between the drive wheel 44 and the pressure roller 50, the lower vane wheel 48 is rotated so that at least one vane 82 to 86 of the lower vane wheel 48 presses the rear edge and/or the lower area of the banknote 38 against the front side of the stack 36.

During feeding of the banknote 38, the upper vane wheel 54 is rotated by altogether 180°, the supplied banknote 38 then being contacted by the flexible second area 76 of the second vane 58 and being pressed against the front side of the stack 36 and kept thereat.

When the front edge of the supplied banknote 38 is detected with the aid of the already mentioned light barrier arrangement, the drive of the vane wheel 54 is started via the drive shaft 55 based on the point in time of the arrival of the front edge of the supplied banknote 38 and a preset delay time. Preferably, the light barrier arrangement comprises a prism arrangement for a double deflection of a light beam emitted by a light source, the light source and a light sensor for detecting the light beam emitted by the light source being arranged on the same side of the transport path for feeding and removing a banknote 38. The prism arrangement is arranged on the opposite side of the transport path. As a result thereof, in particular a reliable detection is provided, since the light beam intersects the transport path of the banknotes twice. Further, a simple compact arrangement of the light source and the light sensor on only one side of the transport path is possible.

Figure 2:
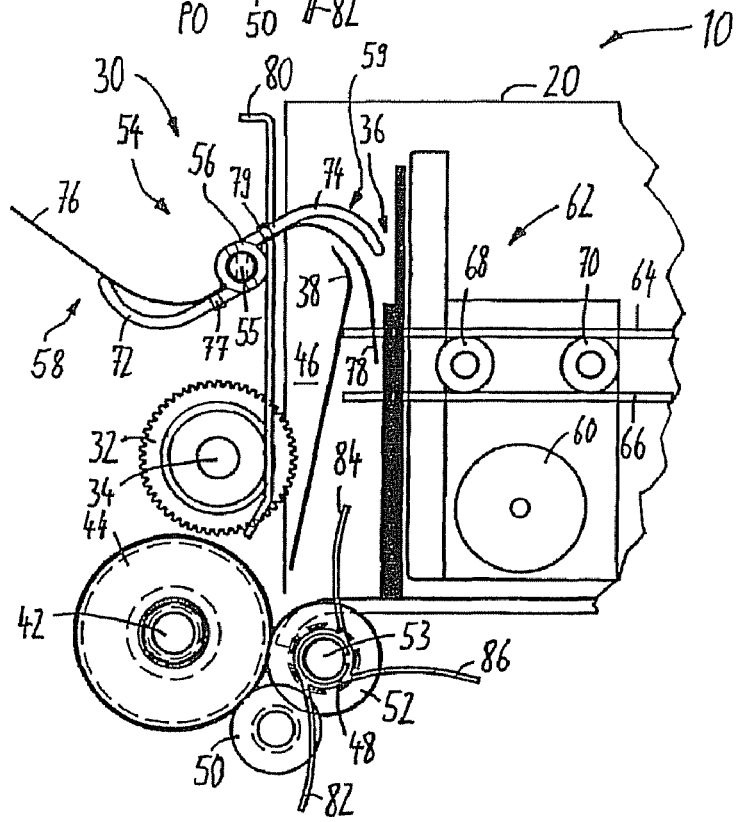
FIG. 2 shows the arrangement according to FIG. 1, the feeding elements being illustrated in a second feeding position.

In FIG. 2, the arrangement 10 according to FIG. 1 is shown, the feeding elements 44, 54 being illustrated in a second feeding position. In contrast to the illustration of the arrangement 10 according to FIG. 1, the upper vane wheel 54 is rotated in the direction of the arrow P2 in FIG. 2. Further, the banknote 38 has been transported further into the feeding area 46 with the aid of the drive wheels 44 and contacts with its front area the flexible second area 78 of the vane 59, the front edge of the banknote 38 being deformed by the bent shape of the outer portion of the area 78. This deformation is also referred to as bending or rolling-up of the front area of the banknote 38.

Figure 3:
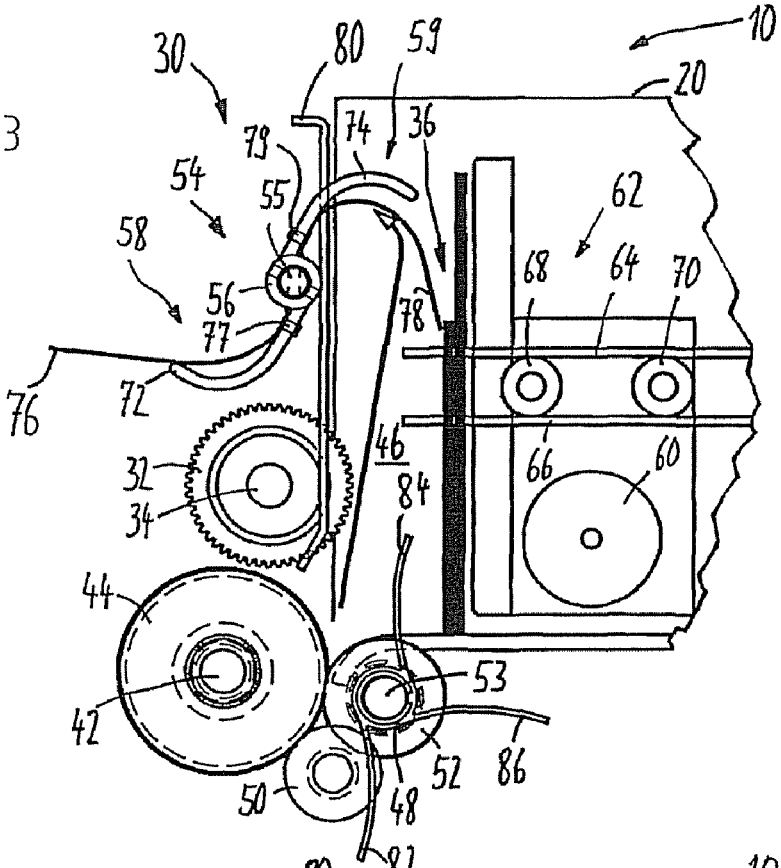
FIG. 3 shows the arrangement according to FIGS. 1 and 2, the feeding elements being illustrated in a third feeding position.

In FIG. 3, the arrangement according to FIG. 1 or 2 is illustrated, the vane wheel 54 and the drive wheel 44 being illustrated in a third feeding position. In contrast to FIG. 2, the vane wheel 54 has been rotated further and the banknote 38 has been transported further into the feeding area 46. As a result of the inertia of the banknote 38, the same is further moved into the feeding area even after leaving the pressure area between the drive wheel 44 and the pressure roller 50 so that the front area of the banknote 38 still contacts the flexible area 78 of the vane 59.

Figure 4:
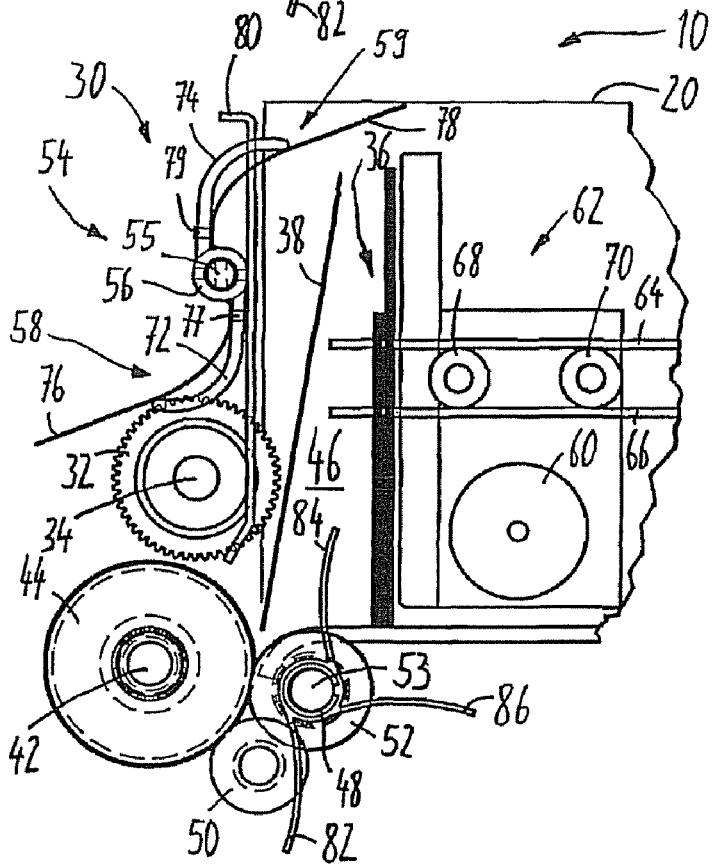
FIG. 4 shows the arrangement according to FIGS. 1 to 3, the feeding elements being illustrated in a fourth feeding position.

In FIG. 4, the arrangement according to FIGS. 1 to 3 is illustrated, the vane wheel 54 having been rotated further in the direction of the arrow P2 compared to the feeding position of the vane wheel 54 shown in FIG. 3. The longitudinal axes of the rigid areas 72, 74 are almost vertical. In this position, the front edge and the front area of the supplied banknote 38 do no longer contact the area 78 of the vane 59 so that the deformation of the front area of the banknote 38 caused by the contact with the area 78 of the vane 59 is deformed back into its original form due to the stiffness of the banknote 38. As a result thereof, a substantially smooth banknote 38 is positioned in the feeding area 46 in front of the front side of the stack 36. Subsequently, by means of a rotary motion of the lower vane wheel 48 at least the lower area of the supplied banknote 38 is moved towards the stack 36, wherein, in the illustration according to FIG. 4, the vane 82 encloses the rear edge of the banknote 38 and, if necessary, lifts the same as well as moves the lower area of the banknote 38 towards the front side of the stack 36 and presses it against the front side. Thereafter, the lower area of the banknote 38 is repeatedly pressed against the front side of the stack 36 with the aid of the further vanes 86, 84. The vanes 82, 84, 86 of the lower vane wheel 48 are preferably made of a flexible easily elastically deformable material such as rubber or plastic foil and are elastically deformed upon a contact with the front side of the stack 36 when the vane wheel 48 is rotated.

After a vane change-over of the upper vane wheel 54, the second vane 58 enters into the feeding area 46 and contacts the supplied banknote 38 in its upper half and presses it against the front side of the stack 36 by the rotary motion. This pressing takes place both by the curved portion of the rigid area 72 as well as by the flexible area 76. As the flexible area 76 projects beyond the rigid area 72, the flexible area 76 contacts the supplied banknote 38 below the contact area of the rigid area 72 of the vane 58 with the banknote 38. A so-called fluttering of the banknote 38 occurring due to a high feeding speed of the banknote 38 during transport into the feeding area is reduced or avoided by the additional contact of the banknote 38 with the flexible area 76 of the vane 58. The fluttering can be increased or alternatively caused by the pressing of the banknote 38 against the stack 36. By the reduction or, respectively, the dampening of the fluttering, the feeding of a further banknote with only a little distance between the successively supplied banknotes is not impeded.

Figure 5:
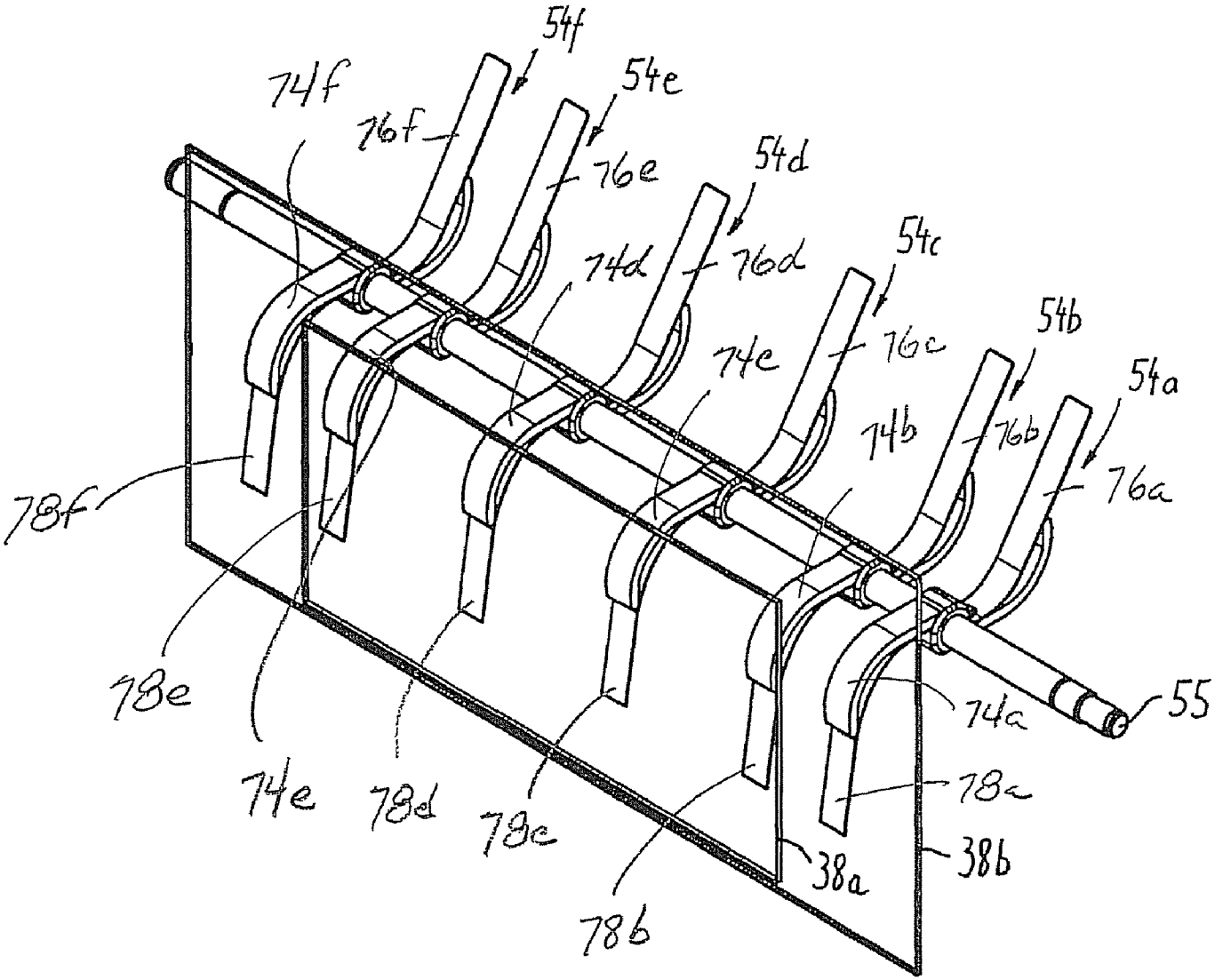
FIG. 5 shows a three-dimensional view of a drive shaft with altogether six two-vaned vane wheels for use in the arrangement according to FIGS. 1 to 4.

In FIG. 5, a three-dimensional view of the drive shaft 55 with altogether six vane wheels 54 is illustrated, which are identified each with the reference sign 54 and a consecutive small letter in FIG. 5. The further elements of the vane wheels 54*a* to 54*f* are identified with the respective reference sign used for this element already in FIGS. 1 to 4 and an additional small letter. In addition, the outlines of two banknotes 38*a*, 38*b* are illustrated in FIG. 5, the banknote 38*b* having the maximum allowable banknote size and the banknote 38*a* having the minimum allowable banknote size. The rigid areas 74*a* to 74*f* contact the banknote 38*b* in its upper half and the flexible areas 78*a* to 78*f* contact it in its lower half. During feeding, the banknote 38*a* is only contacted by the vanes 54*b* to 54*e*. The vanes 54*a* and 54*f* are located to the side of the banknote 38*a* so that these do not contact the front side of the banknote 38*a* even upon a rotation of the vane wheels 54*a* and 54*f*. When the banknote 38*a* is located in front of the banknote 38*b* in the stack, then the banknote 38*a* is held at the front side of the stack 36 by the vane wheels 54*b* to 54*e* and the marginal areas of the banknote 38*b* are additionally held by the vane wheels 54*a* and 54*f*. The vane wheels 54*b* to 54*e* have the same lateral distance to one another, the outer vane wheels 54*a*, 54*f* having a smaller distance to the adjacent vane wheels 54*b* or, respectively, 54*e*.

Figure 6:
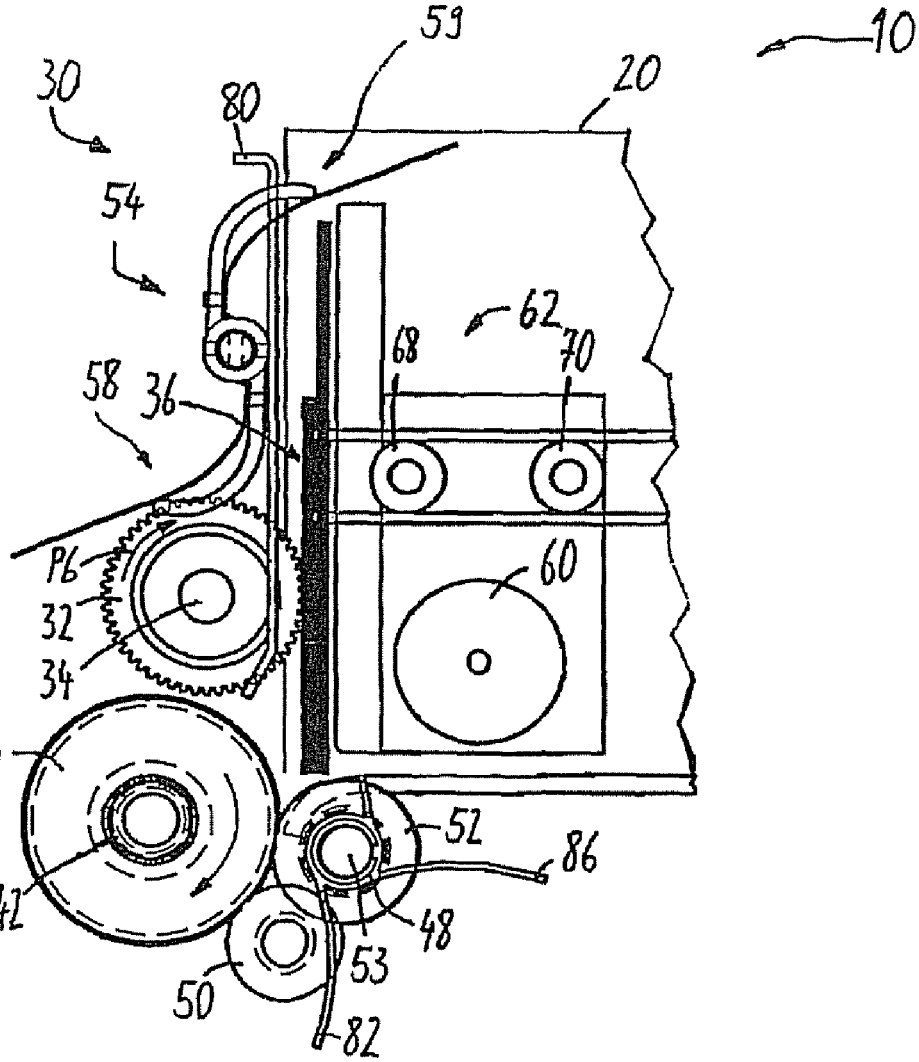
FIG. 6 shows the arrangement according to FIGS. 1 to 4 in a basic separating position.

In FIG. 6, the arrangement 10 according to FIGS. 1 to 4 is illustrated in a separating position. The vane wheel 54 is rotated such that the vanes 58, 59 do not contact the banknotes of the stack 36 or at least do not contact them such that the banknotes of the stack 36 are pressed into the cassette 20. Further, the banknote stack 36 has been moved into a separating position with the aid of the displacement carriage 62 so that the banknote stack 36 is pressed against the surface of the pull-off wheels 32 with a required pressing force. When the pull-off wheels 32 rotate in the direction of the arrow P6, then the banknote 38 present at the front side of the stack 36 is transported downwards relative to the other banknotes of the stack 36 and into the transport gap between the drive wheel 44 and the stripping roller 52 or, respectively, between the drive wheel 44 and the pressure roller 50.

When the banknote 38 is pulled-off or, respectively transported away, the stripping roller 52 is not rotated or rotated opposite to the transport direction of the banknote 38 to be removed. As a result thereof, a further banknote possibly adhering to the rear side of the banknote 38 to be transported away (double pull-off) is prevented from reaching further up into the gap between the drive wheel 44 and the pressure roller 50. As a result thereof, this further banknote remains in the cassette 20 or, respectively, in the area in front of the pull-off wheel 32 or, respectively, in the stack 36.

The invention is thus based on the principle to extend the rigid vanes 72, 74 of the upper vane wheel 54 by additional flexible areas 76, 78. Here, bending-resistant foils have proven to be particularly advantageous. In tests with the separating and stacking module 30, foil strips of polyester foil having a thickness of 0.3 mm have proven to be favorable. Further, lengths of the foil strips in the range between 30 mm and 60 mm, in particular of 50 mm, have proven to be favorable. Foil strips having the same width as the width of the rigid areas 72, 74 have been used. In the specific embodiment the width of the foil strips was 6.5 mm. However, in tests, widths in the range between 4 to 8 mm have proven to be favorable.

The area of curvature of the outer portions of the rigid areas 72, 74 is preferably in the range from less than 180° to 90°, preferably in the range from 100° to 90°. In this range, the foil strips can better conform to the stack 36, at least given an overlapping of the rigid areas 72, 74, as shown in the embodiments, and thus press the supplied banknote 38 reliably against the front side of the already present stack 36. This additional pressing with the aid of the flexible area 76, 78 is also referred to as "propping" the supplied banknote 38 since an uncontrolled movement of the banknote 38 is largely avoided by the additional contact points of the outer portions of the flexible areas 76, 78. As a result thereof, also banknotes having different heights and a relatively bad quality, i.e. showing relatively heavy signs of wear, can be reliably arranged in the stack 36 with high quality.

After feeding of each banknote or a preset number of banknotes the displacement carriage 62 is moved away from the feeding area 46 with the aid of the motor 60 so that the banknote storage space in the cassette 20 is increased. Due to the different banknote properties, in particular as a result of a different waviness of each of the banknotes in the stack 36, a desired contact pressure cannot be guaranteed over a longer period of time when the travel for each supplied banknote 38 is fixedly preset. For this reason, in a specific embodiment of the invention, a motor for driving the shaft 55 is designed as a stepper motor, with the aid of the stepper motor and the rotation of the vane wheel 54 a desired stack contact pressure being set. The stepper motor is rotated at reduced current and a start-stop-frequency from the vertical rotary position into the horizontal rotary position (vertical rotary position=vertical orientation of the non-curved portions of the rigid areas 72, 74; horizontal rotary position=horizontal orientation of the non-curved portions of the rigid areas 72, 74). During rotation of the vanes 58, 59 from the vertical into the horizontal rotary position, the displacement carriage 62 is moved away from the feeding area 46 step by step, after it has been moved as far as possible towards the pressure rollers 32. In addition to the displacement carriage 62, transport belts (not illustrated) circulating at the bottom of the cassette 20 are arranged on which at least some of the banknotes of the stack 36 stand on their longitudinal edges. These bottom belts are likewise driven with the aid of a drive unit arranged outside of the cassette 20 such that the banknotes placed thereon are conveyed further into the cassette 20. As a result thereof, the contact pressure of the banknote stack 36 against the vanes 58, 59 of the upper vane wheel 54 is reduced.

If the force of the stepper motor at reduced motor current is not sufficient to move the vane wheel 54 up into the horizontal rotary position, the breakdown torque of the stepper motor is exceeded and the vane wheel 54 is pushed back into the horizontal rotary position. Subsequently, in a further try the vane wheel 54 is rotated from the vertical rotary position into the horizontal rotary position and the displacement carriage 62 is displaced further into the cassette 20 and the bottom belts are further driven. This operation is repeated until the contact pressure of the stack 36 against the vanes 58, 59 of the vane wheel 54 contacting the front side of the stack 36 is so little that the stepper motor can rotate the vanes 58, 59 from the vertical rotary position into the horizontal rotary position at reduced motor current. By the flexible portions of the vanes 58, 59, the supplied banknotes are further impeded from being moved too far upwards into the cassette 20 and, as a consequence, from not standing with their longitudinal edges on the bottom of the cassette 20 or, respectively, on the transport belt. Further, a minimum distance should be provided between two banknotes to be successively supplied. A minimum distance of 55 mm given a transport speed of the supplied banknotes of 1.4 m per second has proven to be favorable. With this minimum distance, in particular also a slight inclined pulling of the supplied banknotes does not necessarily result in a jam.

The cover of the cassette 20, i.e. the upper cover of the cassette 20, can have guides which are provided for limiting the banknote height and which in particular are adjustable so that they can be set to different allowable note heights. To set these limiting elements such that the stacking space in the cassette 20 has a height of the provided note height+3.5 mm has proven to be favorable. The stacking space of a supplied banknote is thus limited at the top so that the lower longitudinal edge of the banknote, i.e. the note base, remains oriented in parallel to the stack support plane in the cassette 20. This is a prerequisite for a trouble-free re-separation, i.e. for a subsequent removal and transport of a previously supplied banknote 38. This re-separation of a supplied banknote 38 is also referred to as recycling or cash recycling.

If in a cassette 20 banknotes of different note heights are to be stored or if the provision of height-adjustable limiting elements arranged on the cover is to be dispensed with, then in particular the upper vane wheels 54 with the flexible areas 76, 78 described in the embodiments according to FIGS. 1 to 6 are suitable to perform a suitable height restriction of the banknotes. By means of the flexible areas 76, 78 a reliable and correct storing of the banknotes in the cassette 20 is achieved. By the flexible areas 76, 78 of the vane wheels 54 a resilient stop is formed since, depending on the design of the flexible areas 76, 78, these can be deformed by a contact with the front edge of a supplied banknote 38.

A mechanically resistant polyester foil having a thickness of 0.3 mm and connected close to the hub 56 of the vane wheel 54 with the rigid area 74 of the vane 59 has proven to be favorable. The upper vane wheel 54 is then preferably driven such that with the aid of the flexible area 78 a dynamic height stop is formed. By the end of the flexible area 78 projecting beyond the end of the rigid area 74 a supplied banknote 38 is guided reliably over a relatively large area towards the stop. Even if the upper vane wheel 54, as already shown in FIGS. 2 and 3, has been rotated out of a basic stacking position. As a result thereof, it is in particular effectively prevented that a supplied banknote 38 can reach upwards up to the cover of the cassette 20 between the front side of the stack 36 already contained in the cassette 20 and the rigid area 74 of the vane 59. Thus, a reliable correct stacking of banknotes in the cassette 20 is possible.

The rigid areas 72, 74 of the vanes 58, 59 take up the stack pressure of the stack 36 over a relatively large angle of rotation. The elastic or flexible areas 76, 78 which project beyond the rigid areas 72, 74, can still deform on the cassette cover and on further elements, such as the note retracting shutter 80, and deform to a smaller radius at least within a certain angle range. When the banknotes are separated, i.e. when at least one banknote is transported away from the cassette 20, there is preferably no contact between the vanes 58, 59 and the banknotes of the stack 36. As already described, the upper area of a supplied banknote 38 is deformed upon contact with the flexible area 78 of the vane 59 so that the supplied banknote 38 is longitudinally compressed at least in the upper area. Preferably, the rotation of the upper vane wheel 54 is stopped at a predefined stop height until at least one vane 82 of the lower vane wheel 48 has enclosed the lower edge of the supplied banknote 38 and presses it against the front side of the stack 36. The front area of the supplied banknote 38 is preferably rolled during longitudinal compression. Additionally or alternatively, a part of the compression length can also be absorbed by a buckling of the banknote 38 in the feeding area 46.

Preferably, at each rigid area 72, 74 a projecting welding cam made of plastic is provided for forming the joint 77, 79. For a rational production of the vane wheel shaft shown in FIG. 5, it is advantageous when the drive shaft 55 is overmolded with the hubs 56 and the rigid areas 72, 74 of the vanes 58, 59 and, in this process, the welding cams are likewise formed.

Further, the foil strips 76*a* to 76*f* and 78*a* to 78*f* are punched out of a foil for producing the flexible areas 76*a* to 78*f*, the foil strips 76*a* to 76*f* and 78*a* to 78*f* being punched out in groups with a connecting bridge, with which they are connected at their outer ends. Thus, in the present embodiment each time six foil strips 76*a* to 76*f*, 78*a* to 78*f* are connected to one another via the connecting bridge and can be further processed as a punched part. The strips 76*a* to 76*f* have the same distance to one another as the rigid areas 72*a* to 72*f* and 74*a* to 74*f*. Thereafter, the punched part is positioned such that the ends of the foil strips 76*a* to 76*f* which are not connected to the connecting bridge are positioned on the welding cams and are welded thereto. Subsequently, the connecting bridge is removed, for example, punched away. In the same manner, a second punched part is connected to the welding cams of the opposite rigid areas 74*a* to 74*f*, the ends of the foil strips 78*a* to 78*f* being positioned on the welding cams and being welded thereto. Thereafter, the connecting bridge of the second punched part is removed.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A single sheet handling device for at least one of input and output of at least one single sheet respectively into and out of a container, comprising:

a vane wheel that has at least one vane, the at least one vane pressing at least a part of sheets arranged in a stack in the container into the container upon a contact of the at least one vane with a front side of the stack or holding them in a position in the container, and the at least one vane having an inner rigid first area and a flexible second area projecting outwardly beyond a curved portion of the first area, the second area being elastically deformed by contact with the curved portion.

2. The device according to claim 1, wherein the at least one vane wheel has a hub with which the vane is firmly connected.

3. The device according to claim 1, wherein the at least one vane of the vane wheel includes two identically formed vanes extending in opposite directions, preferably extending in opposite directions in parallel planes.

4. The device according to claim 1, wherein a front portion of the first area includes the curved portion.

5. The device according to claim 1, wherein an inner end of the second area is connected to the first area in a portion that is set back from an outer end of the first area.

6. The device according to claim 5, wherein the inner end of the second area is connected to a non-curved portion of the first area so that an inner portion of the second area and the curved portion of the first area overlap.

7. The device according to claim 6, wherein the inner end of the second area is connected to the first area near the inner end thereof.

8. The device according to claim 1, wherein the first area is formed by a rigid plastic molded part and the second area is formed by a flexible plastic foil or a strip of rubber material.

9. The device according to claim 8, wherein the plastic foil is a polyester foil having a thickness in the range between 0.25 mm and 0.35 mm.

10. The device according to claim 1, wherein a non-curved portion of the first area and the second area are arranged in parallel when the second area is not elastically deformed, the second area being elastically deformed by contact with the curved portion of the first area so that at least an outer portion of the second area does not extend parallel to a longitudinal axis of the non-curved portion of the first area of the at least one vane.

11. A single sheet handling device for at least one of input and output of at least one single sheet respectively into and out of a container comprising:

a hub fixedly mounted to a rotatable drive shaft; and a first vane extending from the hub, the first vane including:

a rigid portion including a curved portion; and a flexible portion extending further away from the hub than the rigid portion, the flexible portion being elastically deformed by contact with the curved portion;

wherein the first vane is configured to press or hold sheets arranged in a stack in the container.

12. The device of claim 11, further comprising a second vane extending from the hub, the second vane is identical to the first vane, the first vane and the second vane extend from the hub in opposite directions.

13. The device of claim 11, wherein the flexible portion is spaced apart from the shaft.

14. The device of claim 11, wherein the flexible portion is connected to the rigid portion.

15. The device of claim 11, wherein the flexible portion overlaps the rigid portion; and wherein the flexible portion and the rigid portion extend from the hub in a plane that is perpendicular to a longitudinal axis of the drive shaft.

16. A single sheet handling device for at least one of input and output of at least one single sheet respectively into and out of a container comprising:

a rotatable drive shaft; and a first vane coupled to the drive shaft, the first vane including:

a rigid portion including a curved portion; and a flexible portion overlapping the rigid portion in a plane perpendicular to the drive shaft, and extending further away from the drive shaft than the rigid portion, the flexible portion being elastically deformed by contact with the curved portion;

wherein the first vane is configured to press or hold sheets arranged in a stack in the container.

17. The device of claim 16, further comprising a hub mounted directly to the drive shaft, the first vane is coupled to the drive shaft with the hub; and wherein a second vane is coupled to the drive shaft with the hub, the second vane and the first vane extend from the hub in opposite directions in the plane.

18. The device of claim 16, wherein the flexible portion is connected to the rigid portion, and the flexible portion is spaced apart from the shaft.

19. The device of claim 16, further comprising a hub mounted directly to the drive shaft, the first vane is coupled directly to the hub.

20. The device of claim 16, wherein the rigid portion contacts the flexible portion at a distal tip of the rigid portion.

* * * * *